United States Patent [19]

Szelagowski et al.

[11] Patent Number: 4,516,521

[45] Date of Patent: May 14, 1985

[54] APPARATUS FOR THE COATING OF WORKPIECES BY FLAME SPRAYING

[75] Inventors: Peter Szelagowski, Elmshorn; Siegfried Motzkau, Geesthacht, both of Fed. Rep. of Germany

[73] Assignee: Kernforschungszentrum Karlsruhe G.m.b.H., Karlsruhe, Fed. Rep. of Germany

[21] Appl. No.: 598,251

[22] Filed: Apr. 9, 1984

[30] Foreign Application Priority Data

Apr. 14, 1983 [DE] Fed. Rep. of Germany ..... 3313533

[51] Int. Cl.[3] ..... B05B 7/20

[52] U.S. Cl. ..... 118/50; 118/47; 118/305; 427/423; 239/288; 239/288.5

[58] Field of Search ..... 118/305, 47, 50, 72; 239/288, 288.5, 290, 300; 427/423

[56] References Cited

U.S. PATENT DOCUMENTS

| | | | |
|---|---|---|---|
| 1,219,642 | 3/1917 | Isaacs | 239/300 |
| 2,644,717 | 7/1953 | Kopperschmidt | 239/290 |
| 2,893,648 | 7/1959 | Berry | 239/288.5 X |
| 3,788,273 | 1/1974 | Tusch et al. | 118/305 |
| 4,270,484 | 6/1981 | Shimatani et al. | 118/305 |
| 4,311,404 | 1/1982 | Kodera | 239/288.5 X |

FOREIGN PATENT DOCUMENTS

| | | | |
|---|---|---|---|
| 267809 | 7/1912 | Fed. Rep. of Germany | 427/423 |
| 548630 | 10/1942 | United Kingdom | 427/423 |

*Primary Examiner*—Shrive P. Beck

[57] ABSTRACT

A spray apparatus for applying metallic or non-metallic coatings onto workpieces by thermal deposition includes a spray gun for discharging a spray mixture which spray gun is mounted on a riser surrounding the discharge opening of the spray gun and supporting the spray gun at a given distance from the workpiece. The riser is adjustable in length so that the spray gun is supported at a variable distance from the workpiece, and further has a gas admission nozzle mounted thereon for admitting gas under pressure to the interior of said riser. At its remote end adjacent the workpiece, the riser has release passages permitting escape of the gas admitted under pressure to the riser and preventing infiltration of the surrounding fluid.

12 Claims, 2 Drawing Figures

APPARATUS FOR THE COATING OF WORKPIECES BY FLAME SPRAYING

BACKGROUND OF THE INVENTION

The invention relates to an apparatus for the coating of the surfaces of a workpiece with a spray gun for the thermic depositing of surface layers.

Flame spraying is a thermic surface coating process for metallic but also non-metallic workpieces. For such a process a flame spraying gun may be utilized, for example, as described in the specifications DVS 2307, 2301.

A combustible gas (usually acetylene which must not be pressurized to more than 1.5 bar), an ignition gas (usually hydrogen), oxygen and powder are combined in a predetermined ratio and a flame jet is formed therefrom, which is directed onto a cleaned and dried surface. The spray material (powder) may consist of metallic or nonmetallic materials as described in DIN-Proposal 32529 and DIN specifications 55928 and 8566, part 2. The thermal energy necessary for the melting of the coating material is obtained either autogenously or electrically.

So far, flame spraying has been utilized only under normal atmospheric conditions. Fields of application are the flame spraying of surfaces in ship building and of off-shore structures as corrosion protection of areas above water level. There is, however, no indication that surface coating by flame spraying would be possible below the surface of the water, under higher than atmospheric pressures or in situ in wet environment. With the flame spraying equipment known so far the process could not be performed under those conditions since no flame would be sufficiently effective. The main object of the present invention nevertheless is to provide an apparatus which permits providing of metallic or non-metallic surfaces with metallic or non-metallic coatings by flame spraying in dry as well as in higher than atmospheric or wet environments with or without higher than normal pressures.

SUMMARY OF THE INVENTION

In a spray apparatus for applying metallic or non-metallic coatings onto workpieces by thermal deposition, a spray gun for discharging a spray mixture is mounted on a riser which surrounds and skirts the discharge path of the spray gun and supports the spray gun at a given distance from the workpiece. The riser is preferably adjustable in length so that the distance of the spray gun from the workpiece may be varied as desired. At least one gas admission nozzle is mounted on the riser for admitting gas under pressure which is discharged through release passages at the end of the riser adjacent the workpiece so as to maintain the interior of the riser under pressure and prevent infiltration of any fluid surrounding the riser.

With the coating apparatus according to the invention, the atomizing gas pressure as well as the spray chamber gas pressure may be adjusted according to the pressure of the environment. The apparatus includes means which permit, alternately drying, preheating and coating of the surfaces without interruption of the procedure. By introducing an additional gas jet the flame jet may be protected from contact with surrounding water or wetness, which contact would result in extinction of the flame. The apparatus is further so designed that, after completion of the coating process, thermal compression may be obtained. There are no technical difficulties which would prevent automation of the coating process. The apparatus according to the invention permits the application of lasting corrosion protective coatings even under difficult conditions and therefore makes it possible to increase the life and wear resistance of equipment and structures.

SHORT DESCRIPTION OF THE DRAWINGS

FIG. 1 is an elevational view, partially in section, of the apparatus according to the invention, and FIG. 2 shows a spacer ring for use in the skirt of the apparatus shown in FIG. 1.

DESCRIPTION OF THE PREFERRED EMBODIMENT

Figures 1, 2:
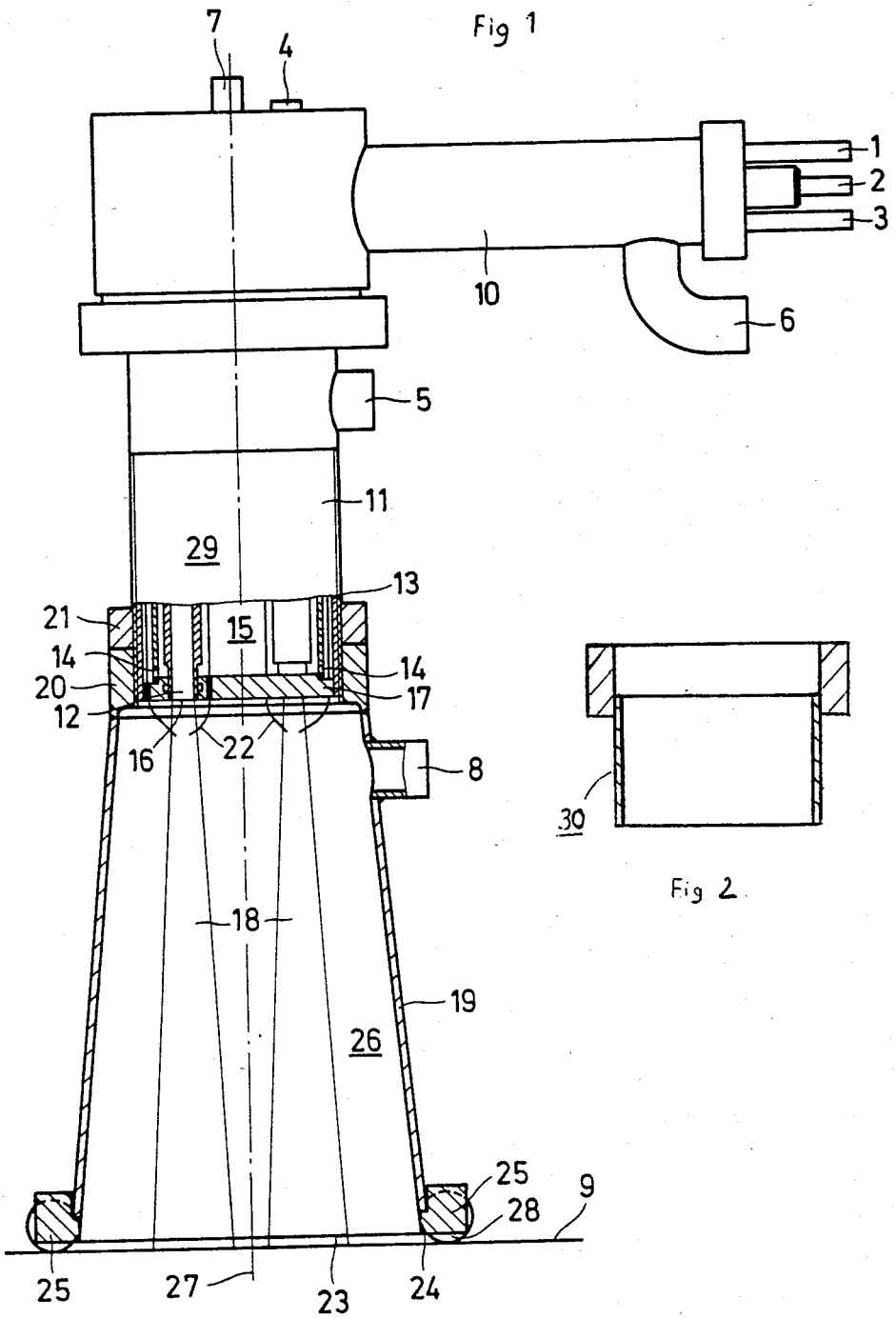

FIG. 1 shows a flame spray gun with three spray jets having a spray capacity of 24 kg/h. The basic design of a flame spray gun with one jet is already known from the various DIN specifications. To provide more than one jet presents no technical problems. The flame spray gun 29 has, at its side, supply ducts 1, 2 and 3 through which a combustible gas, an ignition gas and oxygen are supplied. On top of the mixing chamber there is a supply line 4 for the admission of powder for the various surface coating steps of the workpiece 9. The apparatus sections 10 and 11, which extend at a right angle to one another, are cooled by a cooling chamber supplied with cooling water through admission and discharge ducts 5 and 6. In the portion 11 there are arranged flame jets 12 surrounded by sleeve pipes which are cooled on the outside, the cooling water being supplied from the admission duct 5 to the cylindrical chamber 15 containing the sleeve pipes through a double-cylindrical cooling tube 13 having discharge openings 14 and then to the discharge duct 6.

One of the flame jets as shown in FIG. 1 is disposed in the cross-sectional plane, the others behind this plane; all three together are arranged on a circle. The discharge opening ends of the flame jets 12 extend into a face plate 17 in which they are supported. The flame jets may be arranged in any formation, for example, in a circle or staggered or in any other formation depending on the purpose. For layered coatings of different mixtures the jets may be aligned, for example, or they may be arranged for suitable supply of drying air. From the face plate 17 in the discharge direction of the spray jets 18 extends a protective riser 19 shaped like an inverted cup with downwardly increasing diameter. The riser 19 is mounted on the spray gun by means of mounting rings 20, 21 which may be telescopically movable on the spray gun. The face plate 17 further carries ignition members 22 for the jets 12 which ignition members are essentially two ignition wires like the ignition wires of an oil burner. Electric power is supplied to the ignition wires through a power supply connector 7. The ignition wires 22 are, of course, insulated in the face plate 17.

The spray jet beams 18 emitted from the openings 16 become wider toward the workpiece 9 at the end of the protective riser 19. The length of the protective riser 19, that is, the distance of the openings 16 from the workpiece 9, may be made adaptable to various requirements by providing adapter (spacer) rings 30 (FIG. 2) which are insertable into the riser 19, for example, over and between the mounting rings 20, 21 or by providing a telescopic arrangement for the riser. At the open end, that is, at the discharge opening 23 of the riser 19, there is a circumferential gap 28 between the front edge 24 and the workpiece 9 maintained by spacer rollers 25 which are distributed over the circumference of the riser 9. The gap 28 serves as a discharge opening for gases and vapors including steam, especially during use of the apparatus under pressure or underwater. Gap size and shape of this discharge opening depend on the conditions under which the coating process is performed. It may be advisable, for example, to provide a flexible sleeve at the lower edge of the riser, to provide a ring of bristles or a sleeve with a large number of parallel slots. A suitable choice depends to a great extent on the surface conditions of the workpiece 9.

In order to provide in the riser 19 a pressure capable of counteracting the surrounding pressure, the riser 19 has a supply nozzle 8 through which, for example, pressurized air may be injected into the interior 26 of the riser 19. The pressurized air also serves to remove water or wetness from the interior of the riser 19, to keep water or other liquids out of the riser and to dry the surface of the workpiece 9. As shown in FIG. 1, the nozzle 8 is arranged radially so that the pressurized air enters the interior 26 of the riser 19 in radial direction. However, the nozzle 8 may be arranged differently, for example, at an angle to the central axis 27 of the riser 19 so that it is directed toward the gap 28 or in a tangential direction so that the pressurized gas enters the interior 26 of the riser tangentially.

We claim:

1. An apparatus for underwater flame spraying of coatings onto the surface of a workpiece, said apparatus comprising a flame spray gun for the thermal deposition of the coatings, said spray gun having at least one burner jet discharge opening at its front end for discharging a combustible gas and spray mixture and an ignition device associated therewith for igniting the gas mixture discharged therefrom so as to generate a flame, a riser mounted on the front end of said spray gun, said riser surrounding said discharge opening and having a variable length so as to extend from said spray gun to an adjustable extent, said riser further having a release passage at its end remote from the spray gun with which it is adapted to be disposed adjacent said workpiece for the release of gases and vapors from the interior of said riser, and a gas admission nozzle mounted on said riser for admitting gas under pressure to the interior to said riser for the displacement of water therefrom and for drying the surface to be coated in cooperation with the heat generated by the flame of said burner jet.

2. An apparatus according to claim 1, wherein said spray gun has several gas and spray mixture discharge jets which are disposed in such a manner as to provide a predetermined spray pattern from said spray jets on the surface of said workpiece.

3. An apparatus according to claim 1, wherein means are provided for changing the length of said riser.

4. An apparatus according to claim 1, wherein said riser is cup shaped such that it is wider at its open end remote from said spray gun and spacer rollers are arranged at the open end of said riser around the circumference thereof.

5. An apparatus according to claim 1, wherein discharge slots are formed in said riser at said release opening.

6. An apparatus according to claim 5, wherein a flexible seal sleeve extends around said riser at the open end thereof.

7. An apparatus according to claim 5, wherein a bristle ring is provided at the open end of said riser.

8. An apparatus according to claim 5, wherein said spacer rollers are so arranged that a circumferential gap remains between the open end of said riser and said workpiece when disposed on said workpiece.

9. An apparatus according to claim 1, wherein said gas admission nozzle extends radially with respect to the axis of said riser.

10. An apparatus according to claim 1, wherein said gas admission nozzle extends at an angle to the axis of said riser.

11. An apparatus according to claim 1, wherein said riser has a plurality of gas admission nozzles mounted thereon so as to be spaced about the circumference thereof.

12. An apparatus according to claim 3, wherein said riser has spacer rings so associated therewith that they are removable for a reduction of its length and insertable for an increase in its length.

* * * * *

UNITED STATES PATENT AND TRADEMARK OFFICE

CERTIFICATE OF CORRECTION

PATENT NO. : 4,516,521

DATED : May 14, 1985

INVENTOR(S) : Peter Szelagowski et al.

It is certified that error appears in the above-identified patent and that said Letters Patent is hereby corrected as shown below:

On the title page assignee should read:

--(73) Assignee: GKSS Forschungszentrum Geesthach GmbH, Fed. Rep. of Germany --.

Signed and Sealed this

*Tenth* Day of *December 1985*

[SEAL]

*Attest:*

DONALD J. QUIGG

*Attesting Officer*

*Commissioner of Patents and Trademarks*